US006247441B1

(12) United States Patent
Sato et al.

(10) Patent No.: US 6,247,441 B1
(45) Date of Patent: Jun. 19, 2001

(54) FUEL INJECTION CONTROL SYSTEM

(75) Inventors: Takayuki Sato; Masahiko Kato; Hitoshi Motose, all of Hamamatsu (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/291,825

(22) Filed: Apr. 14, 1999

(30) Foreign Application Priority Data

Apr. 15, 1998 (JP) ..... 10-104373

(51) Int. Cl.[7] ..... F02M 51/00
(52) U.S. Cl. ..... 123/198; 123/41.31
(58) Field of Search ..... 123/41.31, 541, 123/333, 335, 478, 198 D

(56) References Cited

U.S. PATENT DOCUMENTS 5,150,685 * 9/1992 Porter et al. ..... 123/478
5,404,843 * 4/1995 Kato ..... 123/688
5,715,793 * 2/1998 Motose ..... 123/488
5,755,207 * 5/1998 Kushibe ..... 123/478

* cited by examiner

*Primary Examiner*—Marguerite McMahon
*Assistant Examiner*—Jason A Benton
(74) *Attorney, Agent, or Firm*—Knobbe, Martens, Olson & Bear, LLP

(57) ABSTRACT

An outboard motor has a fuel injected internal combustion engine operating on either a two-cycle or four-cycle principle. In some embodiments, the engine is directly injected while in others it is indirectly injected. The engine features one of a number of methods for reducing the temperature of injector drivers. The methods include sensing the temperature of the injector drivers and decreasing the engine speed if the temperature exceeds a predetermined temperature. Another method involves sensing the duration of a high-speed, high-load operating condition and slowing the engine speed if the duration exceeds a predetermined time period. Yet another method involves activating a cooling fan if the temperature of the injector drivers exceeds a predetermined temperature and activating a warning device if the temperature does not decrease with the fan operating.

21 Claims, 9 Drawing Sheets

FUEL INJECTION CONTROL SYSTEM

BACKGROUND OF THE INVENTION

1. Field of the Invention

The present invention generally relates to a fuel-injected engine for an outboard motor. More particularly, the present invention relates to an improved fuel injection control system for a direct injection internal combustion engine used in a marine environment.

2. Related Art

Two cycle engines are widely used, particularly in applications where high specific outputs and relatively uncomplicated, simple engine constructions are desirable. Thus, two cycle engine are frequently employed as the power plant in a marine outboard motor because of the small space available in the powerhead of such engines and the demand for relatively high performance.

However, because of environmental concerns, there is a desire to significantly improve the performance of two cycle engines particularly in the area of exhaust emission control. One particularly advantageous method for reducing unburned hydrocarbons in the exhaust emissions without sacrificing engine performance is using direct cylinder injection.

It should be noted that, particularly in two-stroke applications, it is desirable to open and close the fuel injectors as rapidly as possible. The rapid opening and closely results in longer available injecting time. To accomplish this rapid opening and closing, the fuel injectors are provided with springs of sufficient stiffness to rapidly close the fuel injector while not causing a rebound opening upon closing. Accordingly, the increased spring stiffness requires a larger current to be circulated through a solenoid which controls opening and closing of the fuel injector.

If the engine speed increases, the fuel injector must be increasingly actuated or if the load on the engine increases, the actuation duration must be increased respectively. Either scenario results in increased energy sent to the transistor that controls the solenoid. The transistor, therefore, is susceptible to rapid increases in temperature over time. Accordingly, high-speed, high-load applications of direct cylinder injected engines or indirectly injected engines featuring certain configurations of injectors are subject to possible heat damage of the transistors.

SUMMARY OF THE INVENTION

Accordingly, one aspect of the present invention involves decreasing the operating temperature of such injector drivers. Another aspect of the present invention involves decreasing the engine speed during high-load, high-speed operating conditions.

Accordingly, one aspect of the present invention involves an engine control method comprising determining when a fuel injector driver overheat condition is impending and then initiating at least one of the following responses: reducing the speed of the engine by altering a volume of fuel injected by a fuel injector; reducing the speed of the engine by altering a timing of an initiation of fuel injection by the fuel injector; reducing the speed of the engine by altering an ignition timing; or activating a cooling fan to increase a level of heat transfer from the fuel injector driver.

Another aspect of the present invention involves an outboard motor comprising a power head. An internal combustion engine is mounted within the power head. The internal combustion engine preferably has at least one fuel injector with a fuel injector driver actuating the fuel injector. A fuel injector driver box preferably contains the fuel injector driver and a sensor capable of monitoring the temperature of the fuel injector driver. A control device preferably communicates with the sensor whereby the control device can initiate an engine speed reduction technique when the fuel injector driver temperature exceeds a predetermined temperature.

Yet another aspect of the present invention involves an engine comprising a cylinder block with at least one cylinder defined within the cylinder block. Preferably, at least one piston is arranged for reciprocation within the cylinder and the piston is connected to an output shaft. A combustion chamber is preferably defined within the cylinder between a cylinder head assembly and an upper surface of the piston. An induction system desirably communicates with the combustion chamber and comprises a throttle valve and a fuel injector. The fuel injector preferably includes an injector driver. An engine speed sensor is positioned proximate the output shaft and is capable of reading an engine speed while a throttle position sensor is capable of determining a throttle position angle. A control unit is in communication with the engine speed sensor and the throttle position sensor, wherein the control unit can initiate an injector driver cooling operation when the engine speed sensor indicates an engine speed above a predetermined engine speed and the throttle position sensor indicates a throttle position angle larger than a predetermined angle.

BRIEF DESCRIPTION OF THE DRAWINGS

These and other features, aspects and advantages of the present invention will now be described with reference to the drawings of several preferred embodiments, which embodiments are intended to illustrate and not to limit the invention, and in which drawings.

DETAILED DESCRIPTION OF THE PREFERRED EMBODIMENTS OF THE INVENTION

Figure 1:
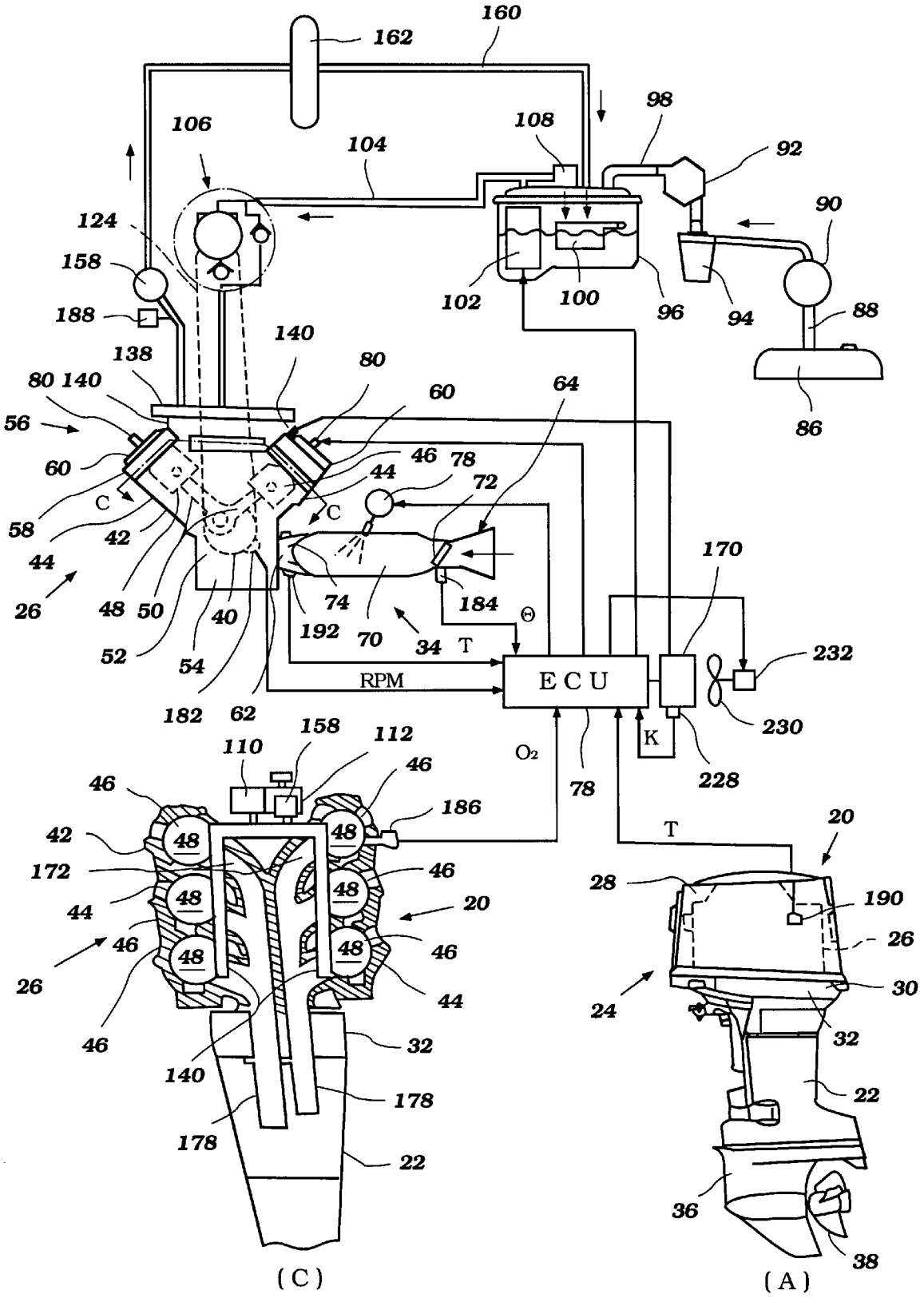
FIG. 1 is a multi-part view showing: (A) in the lower right-hand portion, an outboard motor embodying certain features, aspects and advantages of the present invention; (B) in the upper view, a partially schematic view of the engine of the outboard motor with its induction and fuel injection system shown in part schematically; and (C) in the lower left-hand portion, a rear elevational view of the outboard motor with portions removed and other portions broken away and shown in section along the line C—C in the upper view so as to more clearly show the construction of the engine. An ECU (Electric Control Unit) for the motor links the three views together.

With reference initially to FIGS. 1 through 4, an outboard motor with a fuel injector control system having features, aspects and advantages in accordance with an embodiment of the present invention will be described. In the lower-right hand view of FIG. 1 (i.e., FIG. 1(A)), the outboard motor is depicted in side elevational view and is identified generally by the reference numeral 20.

The entire outboard motor 20 is not depicted in that a swivel bracket and clamping bracket that are usually associated with a drive shaft housing, indicated generally by the reference numeral 22, are not illustrated. It should be understood that these components are well known in the art. Moreover, disclosure of any specific method by which the outboard motor 20 is mounted to a transom of an associated watercraft is not necessary to permit those skilled in the art to understand or practice the present fuel injection control system without undue experimentation.

The outboard motor 20 generally comprises a power head, which is indicated by reference numeral 24, that is positioned above the drive shaft housing 22. The power head 24 advantageously includes a powering internal combustion engine, which is indicated generally by the reference numeral 26. The engine 26 is also shown in the remaining two views of FIG. 1 (i.e., FIGS. 1(B) and 1(C)) and, therefore, will be described in more detail below with reference to these portions of FIG. 1.

The illustrated power head 24 has a protective cowling which generally comprises a main cowling portion 28 and a lower tray portion 30. The illustrated main cowling portion 28 includes a suitable air inlet arrangement, which will also be described in more detail later, to introduce atmospheric air into the interior of the protective cowling. The air present within the protective cowling may then be drafted into an engine air induction system, indicated generally by the reference numeral 34 and described in greater detail directly below.

The main cowling portion 28 is preferably detachably connected to the lower tray portion 30 of the power head 24 around an exhaust guide plate 32. The illustrated exhaust guide plate encircles an upper portion of the drive shaft housing 22 and forms a portion of an exhaust system described in more detail below. Positioned beneath the illustrated drive shaft housing 22 is a lower unit 36 in which a propeller 38, which forms at least a portion of the propulsion device for the associated watercraft, is journaled.

As is typical with outboard motor practice, the illustrated engine 26 is supported in the power head 24 so that a crankshaft 40 (see FIG. 1(B)) may rotate about a generally vertically extending axis. This is done to facilitate connection of the crankshaft 40 to a drive shaft (not shown) that depends into, and extends through, the drive shaft housing 22. The drive shaft (not shown) may drive the propeller 38 through a conventional forward, neutral, and reverse transmission contained in the lower unit 36 in some embodiments.

The details of the construction of the outboard motor 20 and the components which are not illustrated may by considered to be conventional or of any type known to those wishing to utilize the invention disclosed herein. Moreover, those of ordinary skill in the art may readily use or adapt any of a variety of known constructions in order to provide an environment in which the present fuel injection control system may be employed.

Figure 11:
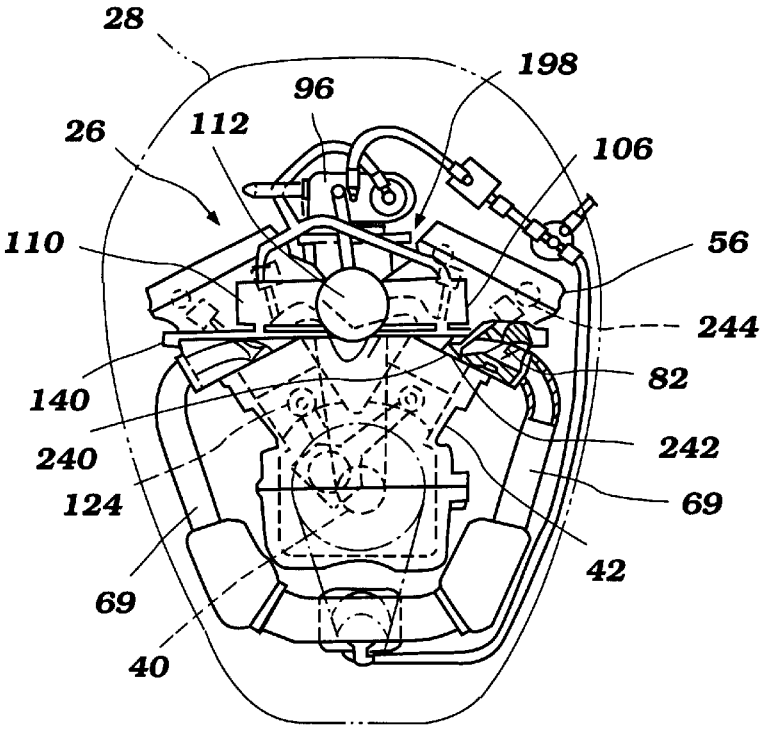

Referring now to FIG. 1, the illustrated engine 26 is of the V6 type and operates on a two stroke, crankcase compression principle. Although the present fuel injection control system is primarily described in conjunction with an engine having this cylinder number and cylinder configuration, it will be readily apparent to those of ordinary skill in the art that the present control system can be utilized with engines having other cylinder numbers and other cylinder configurations. Moreover, the present control system may also find utility with engines operating on other operating principals, such as a four-cycle engine. In fact, an exemplary four-cycle engine embodiment is depicted in FIG. 11 and will be described below in more detail with reference to FIG. 11.

The illustrated engine 26 is comprised of a cylinder block 42 that is formed with a pair of cylinder banks 44. Each of these cylinder banks 44 is preferably formed with three vertically spaced, horizontally extending cylinder bores 46. As will be recognized by those of ordinary skill in the art, a set of corresponding pistons 48 may be arranged and configured to reciprocate in these cylinder bores 46. The illustrated pistons 48 are, in turn, connected to the upper, or small, ends of connecting rods 50. The big ends of the connecting rods 50 are preferably journaled about the throws of the crankshaft 40 in a well-known manner.

With continued reference to FIG. 1(B), the illustrated crankshaft 40 is journaled in any suitable manner for rotation within a crankcase chamber 52. Desirably, the crankcase chamber 52 is formed, in part, by a crankcase member 54 that may be connected to the cylinder block 42 in any suitable manner. As is typical with two stroke engines, the illustrated crankshaft 40 and crankcase chamber 52 are formed with dividing seals such that each section of the crankcase chamber 52 associated with one of the cylinder bores 46 may be sealed from the other sections that are associated with corresponding cylinder bores. This type of construction is also well known in the art.

With reference to FIG. 1(B), a cylinder head assembly, indicated generally by the reference numeral 56, is preferably connected to an end of each of the cylinder banks 44 that is spaced from the crankcase chamber 52. Each cylinder head assembly 56 is generally comprised of a main cylinder head member 58, which defines a plurality of recesses (not shown) in its lower face, and a cylinder head cover member 60. In the illustrated engine 26, each of the recesses (not shown) corporate with a respective cylinder bore 46 and a head of a respective piston 48 to define a plurality of combustion chambers. The cylinder head cover member 60 completes the illustrated cylinder head assembly 56. The cylinder head components 58, 60 are desirably secured to each other and to the respective cylinder banks 44 using any suitable manner.

With reference to FIG. 1(B), the air induction system 34 is provided for delivering an air charge to the sections of the crankcase chamber 52 associated with each of the cylinder bores 46. In the illustrated embodiment, communication between the sections of the crankcase chamber and the air contained within the cowling occurs, in part, via an intake port 62 formed in the crankcase member 54. The intake port 62 registers with a crankcase chamber section corresponding to each of the individual cylinder bores 46.

The induction system 34 also includes an air silencing and inlet device, which is shown schematically in FIG. 1(B), indicated generally by the reference numeral 64. The actual construction of this air charge device appears in FIGS. 2 and 4. In one embodiment, the device 64 is contained within the cowling member 28 at the cowling's forward end and has a rearwardly facing air inlet opening 66 through which air is introduced into the silencer 64.

Figure 2:
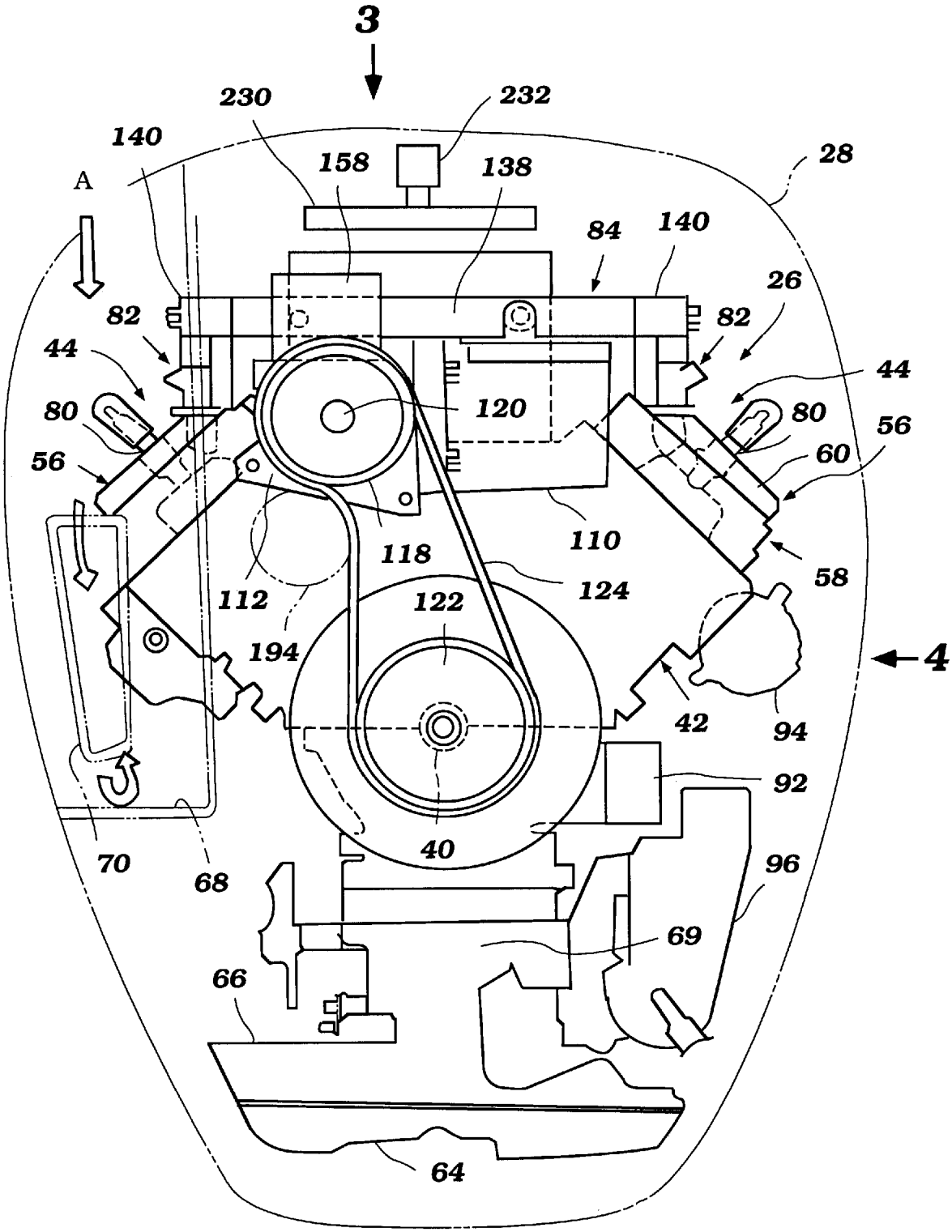
FIG. 2 is a top plan view of the power head of FIG. 1 of a motor showing the engine in solid lines and the protective cowling in phantom.
Figure 4:
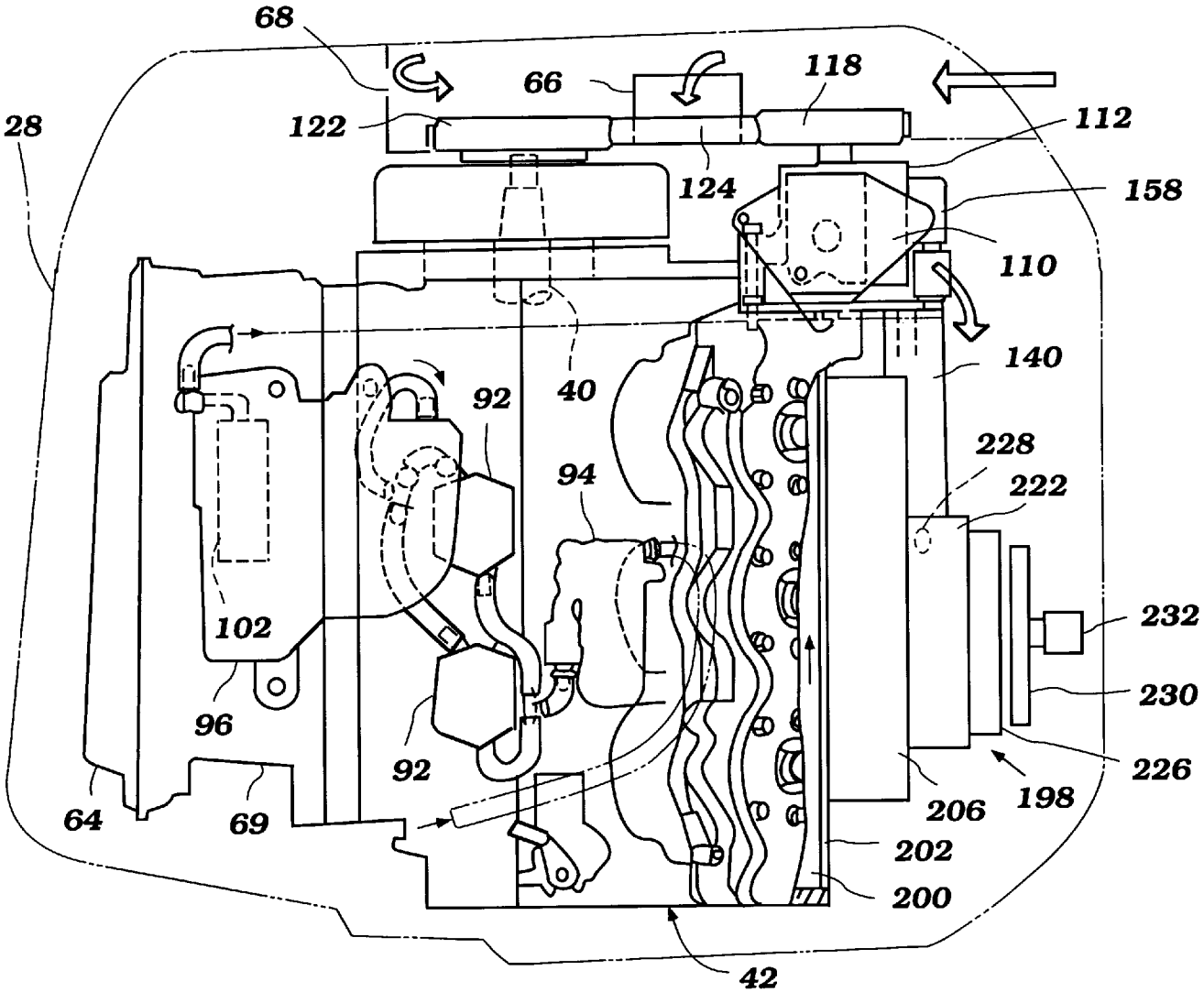
FIG. 4 is a side elevational view of the power head showing the engine with solid lines and the protective cowling with phantom lines and taken generally in the direction indicated by arrow 4 in FIG. 2.

The main cowling portion 28 preferably has an inlet recess 68, which is shown in phantom in FIGS. 2 and 4, that is partially closed by a cover member (not shown) to define the atmospheric air inlet opening. The air drawn through this inlet opening enters the interior of the main cowling portion 28 and is inducted into the silencer 64 through the inlet opening 66 as shown by the arrows in FIGS. 2 and 4.

The air inlet device 64 supplies the induced air to a plurality of throttle bodies, or induction devices, 70 each of which preferably has a throttle valve 72 provided therein. The illustrated throttle valves 72 are desirably supported on throttle valve shafts (not shown) that are linked to each other for simultaneous opening and closing of the throttle valves 72 in a manner that is well known to those of ordinary skill in the art.

Lubricant pumps 76 are provided for spraying lubricant into the throttle bodies 70 for engine lubrication under the control of an ECU (Electronic Control Unit) 78 that will be described more in detail later. Although it is not shown, some forms of direct lubrication may be also employed for delivering lubricant directly to certain components of the engine.

As is also typical in two-cycle engine practice, the illustrated intake ports 62 include reed-type check valves 74. The check valves 74 permit inducted air to flow into the sections of the crankcase chamber 52 when the pistons 48 are moving upwardly in their respective cylinder bores 46. However, as the pistons 48 move downwardly, the charge will be compressed in the sections of the crankcase chamber 52. At that time, the reed type check valve 74 will close to permit the charge to be compressed.

The charge, which is compressed in the sections of the crankcase chamber 52, is then traasferred to the combustion chambers (not shown) through a scavenging system or the like that terminates in scavenging ports (not shown) in a manner that is well known.

A spark plug 80 is mounted in the cylinder head assembly 56 for each cylinder bore 46. The spark plugs 80 are fired under the control of the ECU 78 in any suitable manner.

The spark plug 80 ignites a fuel air charge that is formed by mixing fuel directly with the intake air in the combustion chambers (not shown) via a respective fuel injector 82. The fuel injectors 82 are preferably of the solenoid type and are preferably electrically operated under the control of the ECU 78. The fuel injectors 82 may be mounted directly in the cylinder head 56 in a specific location to provide optimum fuel vaporization or diffusion under all running conditions.

Fuel is supplied to the fuel injectors 82 by a fuel supply system, indicated generally by the reference numeral 84 (see FIGS. 1(B) and 1(C)). The fuel supply system 84 comprises a main fuel supply tank 86 that is provided in the hull of the watercraft with which the outboard motor 20 is associated. Fuel is drawn from this tank 86 through a supply conduit 88 by means of a first low pressure pump 90 and a plurality of secondary low pressure pumps 92. The first low pressure pump 90 is preferably a manually operated pump and the second low pressure pump 92 is preferably a diaphragm type pump operated by variations in pressure in the sections of the crankcase chamber 52. Thus, the pumps 90, 92 may provide a relatively low pressure draw on the fuel supply.

A quick disconnect coupling (not shown) may be provided along the conduit 88. In addition, a fuel filter 94 may be positioned along the conduit 88 at an appropriate location within the main cowling portion 28 for ease of servicing.

From the low-pressure pumps 90, 92, fuel is supplied to a vapor separator 96 which is mounted on the engine 26 or within the cowling portion 28 at an appropriate location. The fuel is supplied to the vapor separator 96 through a supply line 98. At the vapor separator end of the supply line 98, there is provided at a valve (not shown) that may be operated by a float 100 so as to maintain a substantially uniform level of fuel in the vapor separator 96.

An electric fuel pump 102 is provided in the vapor separator 96 and controlled by the ECU in a known manner. The fuel pump 102 pressurizes the fuel that is delivered through a fuel supply line 104 to a high pressure pumping apparatus, indicated generally by the reference numeral 106. The electric fuel pump 102, which is driven by an electric motor, develops a pressure such as 3 to 10 kg/cm$^2$. A low pressure regulator 108 is positioned in the line 104 at the vapor separator 96 and limits the pressure that is delivered to the high pressure pumping apparatus 106 by dumping the fuel back to the vapor separator 96.

Figure 3:
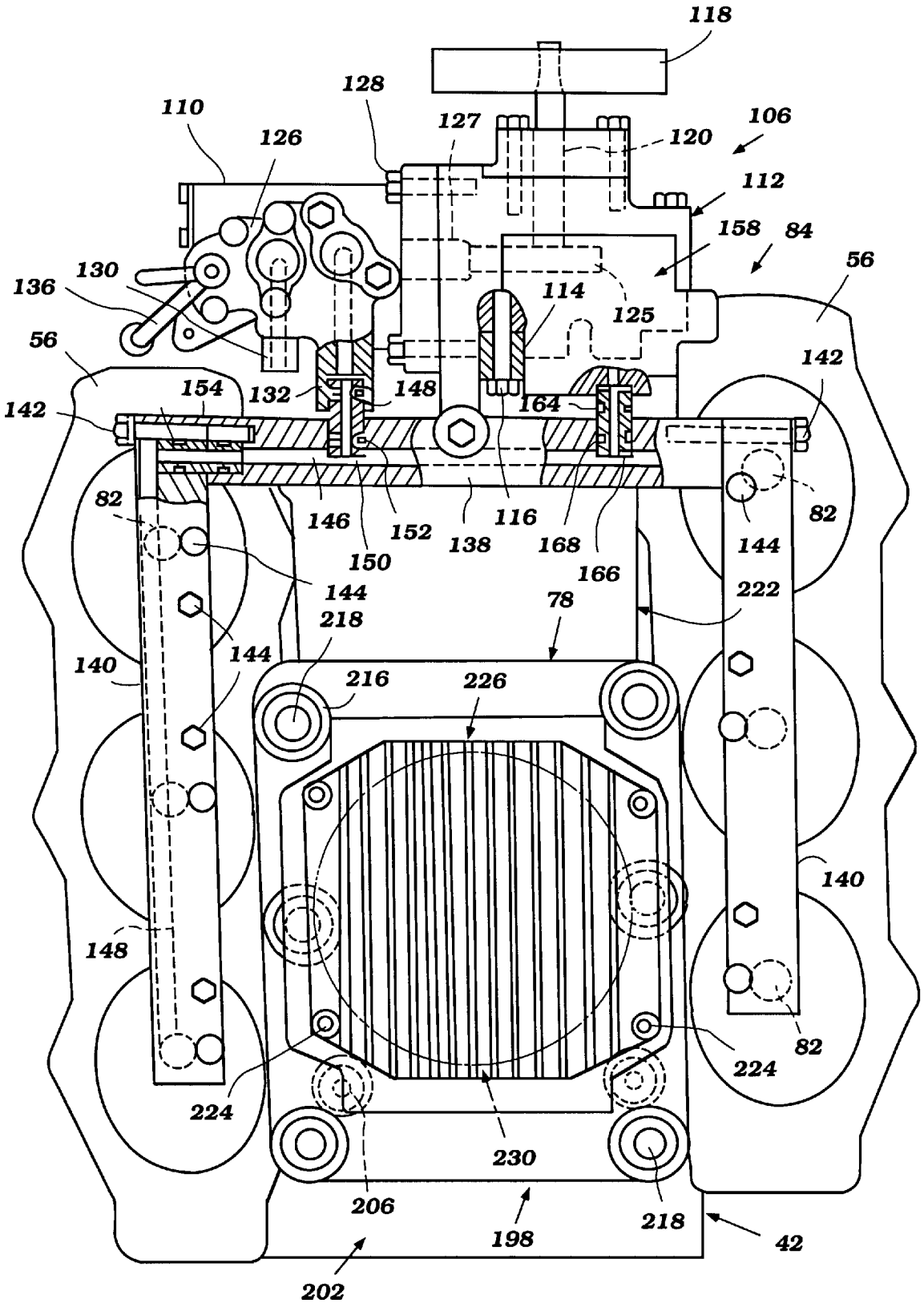
FIG. 3 is a rear elevational view of the engine shown partly in cross-section taken generally in the direction indicated by arrow 3 in FIG. 2.

The high pressure fuel delivery system 106 includes a high pressure fuel pump 110 that can develop a pressure of, for example, 50 to 100 kg/cm$^2$ or more. A pump drive unit 112 (see FIG. 1(C)) is provided for driving the high-pressure fuel pump 110. Referring to FIGS. 2–4, the pump drive unit 112 is partly affixed to the cylinder block 42 via a mounting plate 114 with bolts 116 and is partly directly affixed to the cylinder block 42 so as to overhang between the two banks 44 of the V arrangement. A pulley 118 is affixed to a pump drive shaft 120 of the pump drive unit 112. The pulley 118 is driven by means of a drive belt 124 wrapped about a driving pulley 122 affixed to the crankshaft 40. The pump drive shaft 120 is preferably provided with a cam disc 125 for operating one or more pumping plungers 127 of any known type.

The high pressure fuel pump 110 (FIG. 3) has a unified fuel inlet and outlet module 126 which is mounted on a side wall of the high pressure pump 110 by mounting bolts 128. The inlet and outlet module 126 has an inlet passage 130 connected with the line 104 (FIG. 1), an outlet passage 132 connected with a fuel injector supply system indicated generally at 134 and an overflow passage 136 connected with the vapor separator 96 (FIG. 1). The line for returning the overflow fuel to the vapor separator 96 is omitted in the drawings.

Fuel is supplied from the high-pressure fuel pump 110 to the fuel injector supply system 134 through the supply passage 132. The fuel injector supply system 134 is generally comprised of a main fuel manifold 138 that extends substantially horizontally. The main fuel manifold 138, in turn, delivers fuel to a pair of generally vertically extending fuel rails 140. The fuel rails 140 preferably deliver fuel to the fuel injectors 82.

The illustrated fuel rails 140 are affixed to the main manifold 138 with bolts 142. In addition, the respective fuel rails 140 are preferably affixed to both of the cylinder heads 56 with bolts 144. The illustrated fuel supply conduit 134 is mounted on the engine 26 by means of the pump drive unit 112 via the stay 114, partly directly, at the cylinder block 42 and by means of fuel rails 140 at the cylinder head 58.

The main manifold 138 and the fuel rails 140 are preferably formed with drillings therein to form fuel passages 146, 148 respectively. The fuel passage 146 in the main manifold 138 and the fuel passages 148 in both of the fuel rails 140 are connected to each other in a manner to be described.

The illustrated outlet passage 132 of the fuel inlet and outlet module 126 is connected to the fuel passage 146 of the main manifold 140 with a connector 150 (see FIG. 3), which is sealed by 0-shaped elastic (rubber) rings 152. The main manifold 138 and the fuel rails 140, in turn, are preferably connected together with connectors 154 that are also sealed with the 0-shaped elastic rings 156.

In the illustrated embodiment, the pressure of the fuel supplied by the fuel pump 110 to the fuel injectors 82 is regulated to be the fixed value by a high pressure regulator 158 (See also FIG. 1) which dumps fuel back to the vapor separator 96 through a pressure relief line 160 in which a fuel heat exchanger or cooler 162 is provided. The fuel is desirably kept under constant pressure because the volume of injected fuel is determined by changes of duration of injection under the condition that the pressure for injection is always the same.

The illustrated pressure regulator 158 is also mounted on the pump drive unit 112 with bolts (not shown). The pressure regulator 158 preferably has a passage 164 therein that forms a part of the pressure relief line 160 (FIG. 1) and this passage 164 is connected to the fuel passage 146 in the main manifold 138 with a connector 166 which is also sealed with an 0-shaped elastic ring 168.

As illustrated, the fuel injectors 82 are preferably affixed between the fuel rails 140 and the cylinder head assemblies 56 and receive fuel from the fuel rails 140 in any suitable manner. The fuel injectors 82 are preferably of the solenoid-operated type and are operated from the ECU 78 via a solenoid driver 170.

Returning back to FIG. 1, after the fuel charge has been formed in the combustion chambers by the injection of fuel from the fuel injectors 82, the charge is ignited by firing the spark plugs 80. The injection timing and duration, as well as the control for the timing of firing of the spark plugs 80, are controlled by the ECU 78.

Once the charge burns and expands, the pistons 48 will be driven downwardly in the cylinder bores 46 until the pistons 48 reach a lowermost position. At this time, an exhaust port 172 will be uncovered to allow communication with an exhaust passage 174 (see FIG. 1(B)) formed in the valley of the cylinder block 42. The exhaust gases flow through the exhaust passages 174 to manifold collector sections 176 of respective exhaust manifolds that are formed within the cylinder block 42. The exhaust manifold collector sections 176 communicate with exhaust passages formed in the exhaust guide plate 32 on which the engine 26 is mounted.

A pair of exhaust pipes 178 depend from the exhaust guide plate 32 and extend the exhaust passages 174 into an expansion chamber 180 formed in the driveshaft housing 22. From this expansion chamber 180, the exhaust gases are discharged to the atmosphere through a suitable exhaust system. As is well known in outboard motor practice, this may include an underwater, high speed exhaust gas discharge and an above the water, low speed exhaust gas discharge. Since these types of systems are well known in the art, a further description of them is not believed to be necessary to permit those skilled in the art to practice the invention.

A feedback control system performed by the ECU 78 is provided for realizing a control strategy by which the beginning and duration of fuel injection from the injectors 82 and timing of firing of the spark plugs 80 are controlled. This may be of any known or desired type. The feedback control system generally comprises the ECU 78 as a control unit or device and a number of sensors which sense either engine running conditions, ambient conditions or conditions of the outboard motor 20 that may effect engine performance. Certain of the sensors are shown schematically in FIG. 1 and will be described by reference to that figure. It should be readily apparent to those skilled in the art, however, that other types of sensing and control arrangements may be provided.

In the illustrated embodiment, there is provided a crankshaft angle position sensor 182 associated with the crankshaft 40 which, when measuring crankshaft angle versus time, outputs a crankshaft rotational speed signal or engine speed signal to the ECU 78.

Operator demand or engine load, as determined by throttle angle of the throttle valve 72, is sensed by a throttle position sensor 184 which outputs a throttle position or load signal to the ECU 78.

A combustion condition or oxygen ($O_2$) sensor 186 is provided that senses the cylinder combustion conditions by sensing the residual amount of oxygen in the combustion products at a time near the time when the exhaust port is opened. This output and an air fuel ratio signal are preferably transmitted to the ECU 78.

There is also provided a pressure sensor 188 connected to the pressure regulator 158. This pressure sensor 188 outputs a high-pressure fuel signal to the ECU 78 (its signal line is omitted in FIG. 1).

There also may be provided a water temperature sensor 190 (see FIG. 1(A)) which outputs a cooling water temperature signal to the ECU 78.

Further, an intake air temperature sensor 192 (see FIG. 1(B)) may be provided to output an intake air temperature signal to the ECU 78.

Although these sensors are shown in FIG. 1, it is, of course, practicable to provide other sensors such as an engine height sensor, a trim angle sensor, a knock sensor, a neutral sensor, a watercraft pitch sensor and an atmospheric temperature sensor in accordance with various control strategies.

The ECU 78, as has been noted, outputs signals to the fuel injectors 82, spark plugs 80, the lubrication pumps 76, the high pressure electric fuel pump 102 and a fan motor 232 for their respective control. These control signals are indicated schematically in FIG. 1. As noted previously, those skilled in the art may select a suitable control strategy for practicing the invention, which relates to the placement and spray pattern of the injectors 82.

In addition, a starter motor for starting the engine 26 and a tensioner 194 for giving tension to the belt 142 are provided (see FIG. 2).

Figure 5:
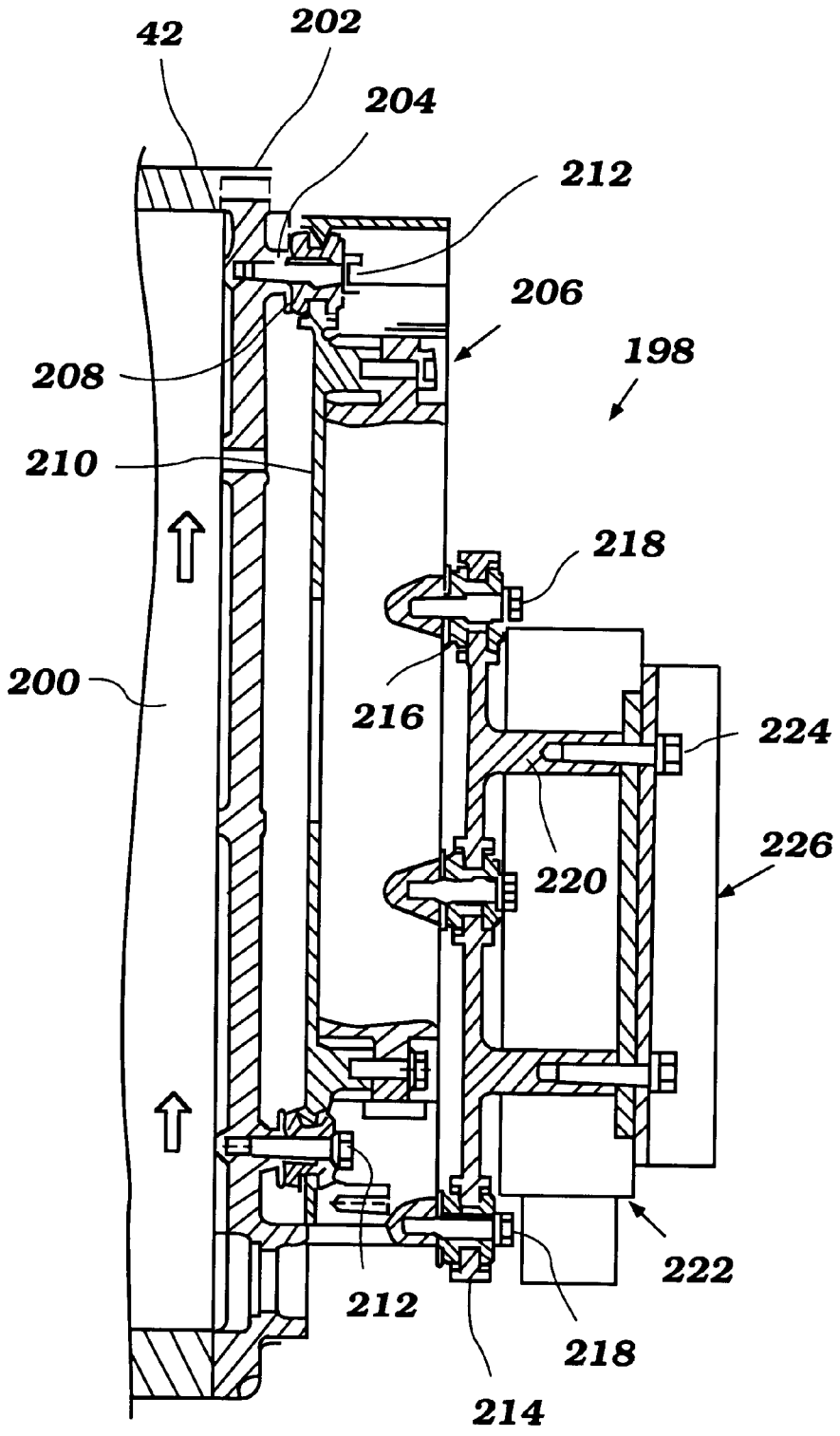
FIG. 5 is a partially sectioned side elevational view of an ECU and injector driver box mounting and cooling arrangement.

With reference now to FIGS. 3 through 5, a mounting arrangement and cooling system for the ECU and injector driver controls will described in detail. In general, the electronic components are generally contained within an electric component box 198 that is preferably water resistant or waterproof. Additionally, the electric component box 198, due to the high levels of heat that may be generated within the box 198, is desirably ventilated for heat transfer in a manner described below.

As illustrated, the engine 26 features a water jacket cooling system as is well known to those of skill in the art. In such systems, cooling water is picked up from the body of water in which the watercraft is operating and circulated through a variety of passageways in and around the exhaust system and cylinder block. As the water is circulated, heat is transferred to the water. The water is ultimately returned to the body of water in which the watercraft is operating either separate from the exhaust gases or together with the release of exhaust gases through a high-speed exhaust outlet.

In the illustrated engine 26, a water passage 200 of the cooling system passes along a forward face of the cylinder block 42. The water passage 200 is preferably defined between a surface of the cylinder block 42 and an outer cover member 202. The outer cover member 202 may be attached to the cylinder block 42 in any suitable manner and may be an integral portion of the cylinder block in some embodiments. The illustrated outer cover member 202 features a plurality of mounting bosses 204 which protrude slightly from a side opposite the cooling passage 200.

With continued reference to FIG. 5, the ECU is desirably contained within an ECU mounting box 206. The ECU mounting box is secured to the cylinder block 42, or to the outer cover member 202, through a plurality of resilient mounts 208. The resilient mounts preferably are designed to reduce the amplitude of vibration transmitted from the engine 26 to the ECU mounting box 206. The resilient mounts 208 may be manufactured from any suitable material and are preferably a soft rubber in one specific embodiment.

As illustrated, the mounts 208 may feature a cylindrical double flange construction wherein a mounting plate 210 is secured within the recess formed between the flanges. A water cooling jacket may also extend between the mounting plate 210 and the outer cover member 202 in some embodiments. The illustrated mounting plate 210 is preferably attached to the outer cover member 202 via threaded fasteners 212 that extend through the mounts 208 into a threaded recess of the outer cover member 202. The threaded fasteners 212 are recessed in the illustrated embodiment but may be accommodated by recesses in adjoining structures or otherwise accommodated if desired.

With continued reference to FIG. 5, the ECU box 206 also preferably features threaded holes on a side opposite the mounting plate 210. An injector driver box mounting bracket 214 is preferably attached to the ECU box 206 using a plurality of resilient mounts 216. Such a resilient mounting, whether through a plurality of mounts or a single resilient structure, advantageously further reduces the transmitted vibrations from the engine 26 to the mounting bracket 214. The illustrated mounting bracket is secured to the ECU box 206 through a plurality of threaded fasteners 218 that extend through the resilient mounts 216 into the threaded holes of the ECU box 206. Moreover, the illustrated mounting bracket 214 features at least one mounting boss 220 that extends substantially away from the engine 26.

An injector driver box 222 is secured to the mounting boss 220 through a set of threaded fasteners 224 as illustrated in FIG. 5. Advantageously, an array of heat transferring fins 226 may be attached to the injector driver box 222 with the same set of threaded fasteners 224. The fins 226 advantageously increase the surface area of the box 222. In this manner, the heat transfer away from the box 222 may be increased. The size and configuration may be optimized for maximum heat transfer in some embodiments.

Figure 6:
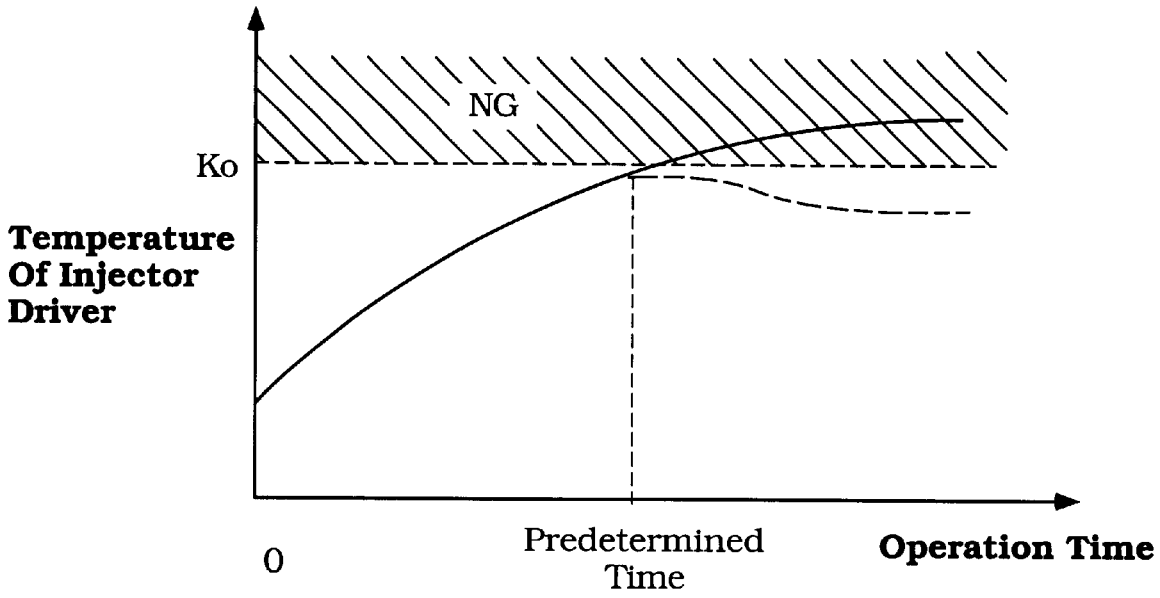
FIG. 6 is a graphical depiction of injector driver temperature over a range of engine operating times.

The electric component box 198, described in detail above, is desirably monitored for temperature increases. In some embodiments, a temperature sensor 228 is mounted within the electric component box 198 to transmit a temperature reading to the ECU 78. In the illustrated embodiment, the temperature sensor is mounted within the injector driver box 222 to transmit signals reflecting the temperature of the injector drivers for reasons that will be discussed below. The signals are preferably transmitted to the ECU 78, which stores and compares the temperature signals to detect when the temperature of the injector drivers exceed a predetermined temperature. As illustrated in FIG. 6, when the injector drivers exceed the predetermined temperature, the ECU activates any of a number of operations that act to cool the injector drivers, as will also be discussed below.

As one of ordinary skill in the art would appreciate, the solenoid-type injectors utilized in the illustrated embodiment are controlled by use of a transistor (not shown). When the ECU 78 determines it is time to inject fuel using the fuel injectors 82, the ECU 78 sends a signal to the transistor. A longer signal would correspond to a larger volume of injected fuel. Because signaling the transistor repeatedly or for a long duration (i.e., a large volume throughput of fuel in a single firing) tends to increase the actual temperature of the illustrated injector driver, the injector driver needs to be cooled such that heat damage to the transistor is not suffered. The need to cool the injector driver is particularly acute with respect to two-cycle engines, because fuel is injected once for each revolution of the crankshaft, and with respect to four-cycle engines operating under high-load scenarios.

Figure 7:
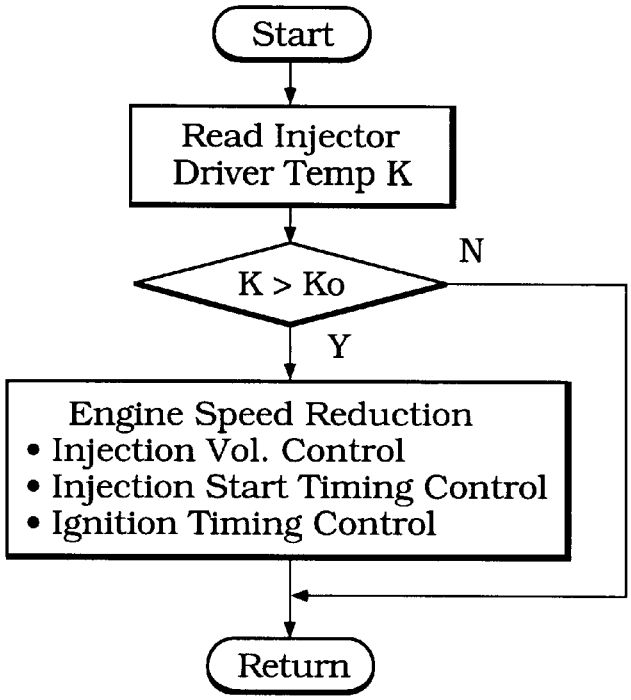
FIG. 7 is a flow chart depicting one embodiment of a fuel injection control system having features, aspects and advantages in accordance with the present invention.

Thus, an exemplary injector cooling strategy or routine is presented in the flow diagram of FIG. 7. As illustrated, the ECU or another control mechanism begins the routine by sampling the actual temperature K of the injector drivers using the sensors 228. In a decision block, the actual temperature is compared to a predetermined temperature. In some embodiments, the predetermined temperature $K_0$ is set significantly below a temperature at which the transistor is rated for failure. In other embodiments, the predetermined temperature is within a few degrees of a failure temperature. In one specific embodiment, the predetermined temperature is approximately just below the failure temperature.

In the decision block of the routine, if it is determined that the actual temperature K is less than the predetermined temperature, the routine returns to the beginning and continues to sample the actual temperature. In the event the actual temperature has exceeded the predetermined temperature, the controller begins a speed reduction routine. Any of a variety of speed reduction routines may be utilized.

Figure 8A:
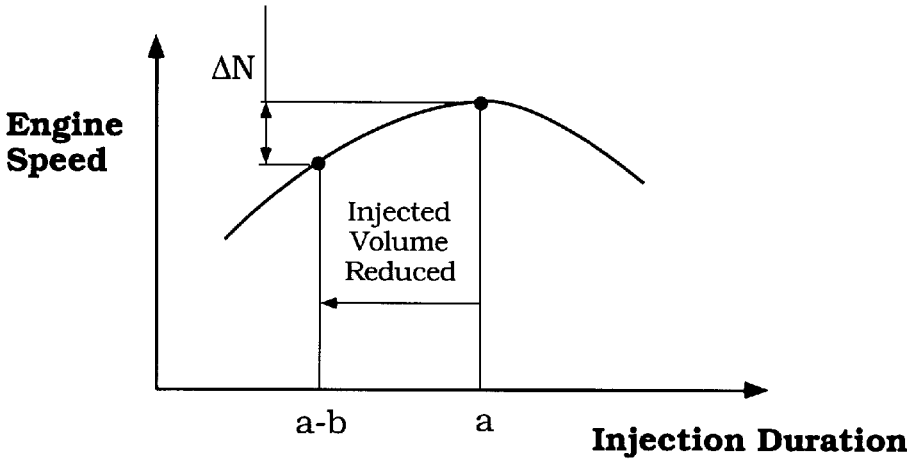
FIGS. 8A through 8C are graphical depictions of engine speeds versus injection duration, start of fuel injection and ignition timing respectively.

For instance, in some embodiments, the controller 78 may control the injection volume. Because the fuel feeding the fuel injectors 82 is desirably maintained at a substantially constant pressure, the duration of the opening of the fuel injectors can control the injection volume. As illustrated in FIG. 8A, the injection duration is preferably controlled to result in an optimum engine speed; thus, if the injection duration is decreased, for instance, the engine speed will decrease an associated amount. It is also possible to increase the injection duration to reduce engine speed; however, such a change in duration may result in excess fuel being passed to the atmosphere in the exhaust as well as further increasing the injector driver temperatures in the illustrated embodiment.

Figure 8B:
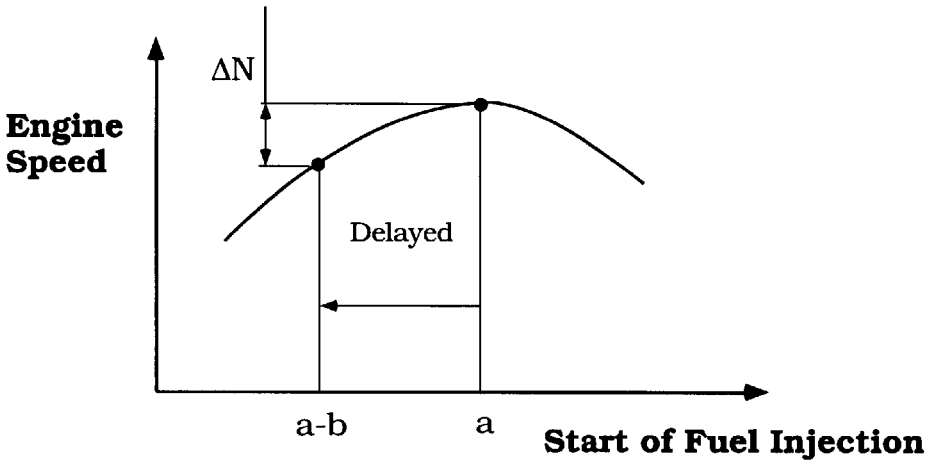

In other embodiments, the controller 78 may control the timing for initiating the injection of fuel by the fuel injectors 82. As illustrated in FIG. 8B, delaying the injection of fuel from the fuel injectors 82 results in a decrease in engine speed if the injection timing has been optimized for engine speed. Moreover, advancing the injection timing may also have the same effect; however, advancing the timing may result in increased fuel being pulled from the combustion chamber with the exhaust during the exhaust stroke. Accordingly, altering the start of injection will decrease the engine speed and lead to a corresponding decrease in the temperature of the injector drivers.

Figure 8C:
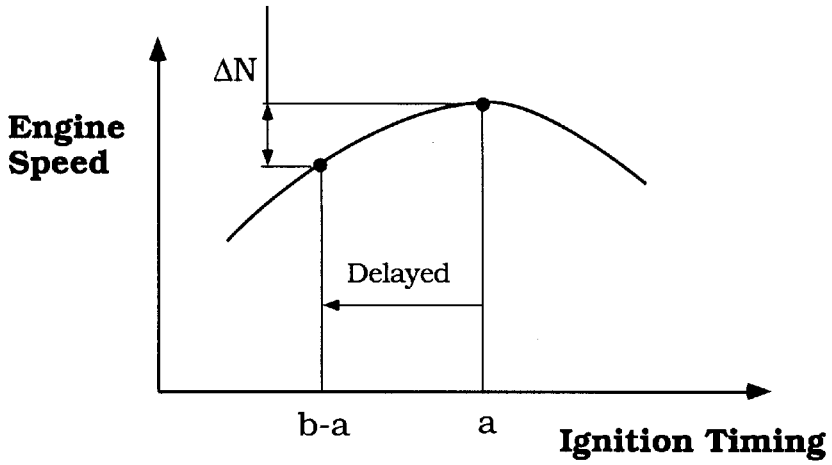

In yet other embodiments, the actual timing of the ignition of the air-fuel charge may be delayed. Again, delaying the actual ignition of the charge results in a reduced engine speed as illustrated in FIG. 8C. Moreover, the engine speed may be advanced in some embodiments. Accordingly, altering the ignition timing will reduce the engine speed and result in a corresponding decrease in the injector driver temperature due a slow down in injection.

As will be recognized, each of these engine speed control strategies may be used separate from, or in conjunction with, any of the other engine speed control strategies in order to decrease the injector driver temperature. In addition, misfiring the engine may be utilized in some embodiment to decrease the engine speed. Moreover, as discussed above, the injector driver housing 214 is provided with a heat transferring from array 226 to increase the amount of heat transferable from the housing 214 through ordinary convection. As described below, a fan 230 powered by an electric motor 232 may be utilized to increase the heat transfer effects of the fins 226.

Once the engine speed reduction is begun, the routine begins again. While not illustrated, the routine monitors whether an engine speed reduction technique is being employed and, if so, whether the technique is necessitated by the operating conditions present at that time. If not, the technique is ended and the routine continues monitoring for excessive temperature increases.

Figure 9:
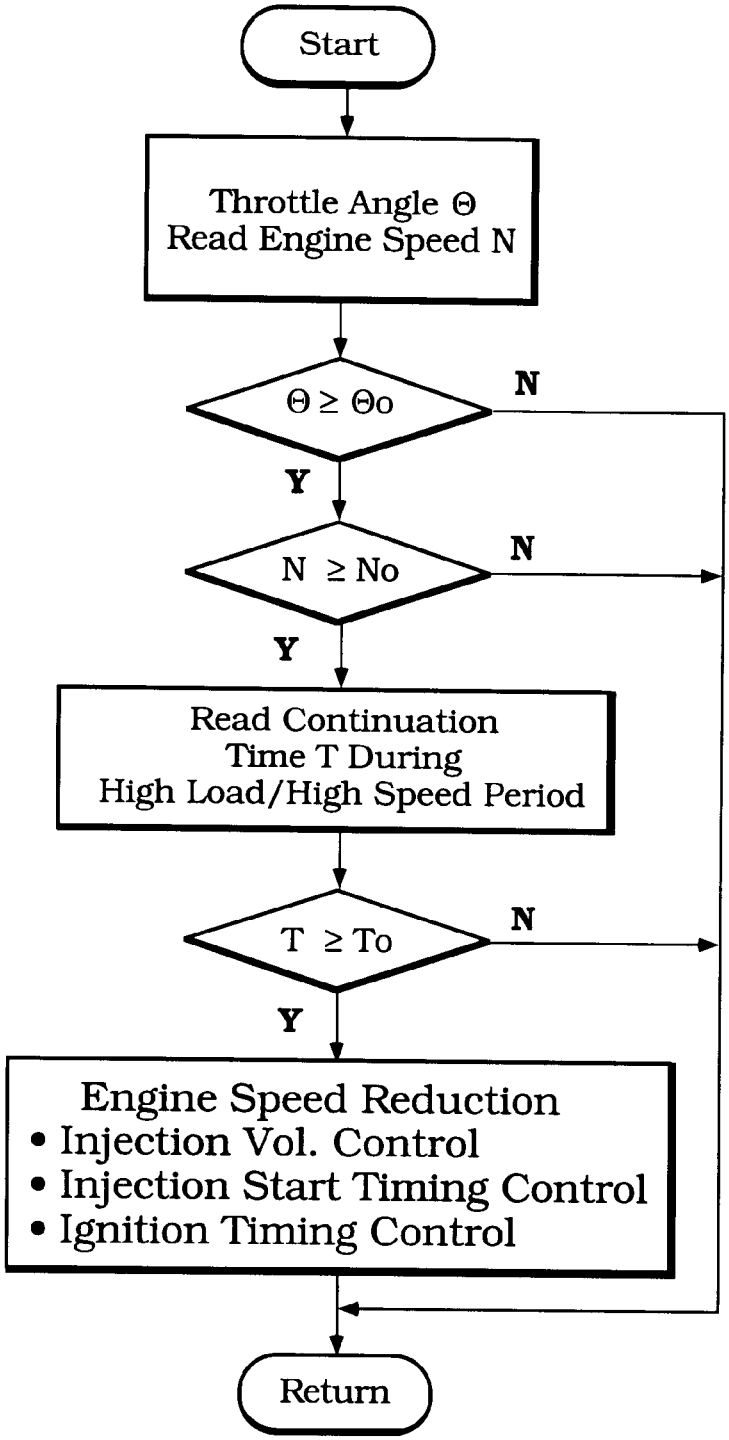
FIG. 9 is a flow chart depicting another embodiment of a fuel injection control system having features, aspects and advantages in accordance with the present invention.

With reference now to FIG. 9, another embodiment of a control system is depicted in a flow diagram. As illustrated, the throttle angle and engine speed are detected through the throttle angle sensor 184 and the crankshaft position sensor 182.

In a decision block, the throttle position is compared with a throttle position indicative of a high load operation. If the throttle position indicates that the engine is in a low load operation, the routine begins again. On the other hand, if the throttle position indicates a high load operation condition, the engine speed is compared against an engine speed indicative of a high-speed operation in a further decision block. If the engine speed is not indicative of a high-speed operation condition, then the routine begins again by sampling the actual engine speed and throttle position. If the engine speed is indicative of a high-speed operation condition, the routine checks the duration or time period T of the high speed-high load condition. Notably, checking for the high-speed condition and checking for the high load condition may be performed in any order or may be performed simultaneously.

In a subsequent decision block, the duration of the high-speed, high-load condition T is compared to a predetermined time period T. The predetermined time period, as indicated in FIG. 6 may be a period of time after which the injector driver temperature would exceed an acceptable operation range without corrective action to reduce the temperature or engine speed. In some embodiments, the predetermined period of time may be a few seconds short of the time at which the driver temperature would exceed the acceptable operation range. In one specific embodiment, the predetermined period of time may precede the time at which the driver temperature would exceed the acceptable range by several seconds (i.e., up to and more than one minute).

If the actual time period is less than this period, the routine begins again while continuously monitoring the continuation time during which the high-speed, high-load condition continues. It should be noted that a separate subroutine may monitor the continuation time T and output the time to the main routine as requested. On the other hand, if the actual time period exceeds the predetermined time period, an evasive engine speed reduction routine is begun. As discussed above, any of a number of engine speed reduction methods, or any combination of the methods, may be used to decrease the engine speed and slow the rate of injector driver actuations. Accordingly, the transistors encounter less voltage swings or less attenuated high voltage periods and the transistor and driver temperatures may decrease.

In the illustrated embodiment, the fan 230 is also provided. The illustrated fan and motor combination may be any suitable combination that enables selective activation of the fan, whether electric or not (i.e., a mechanically clutched fan drive). Moreover, the fan 230 should be capable of selective activation, such as by a thermostat or ECU, for instance. Notably, the cooling fan 230 is preferably positioned to increase air flow across the fin array 226 to amplify the cooling effect of the fins 226. Additionally, the cooling fan 230 may be used separate from, or in conjunction with, any of the above engine speed reduction methods to reduce the operating temperature of the injector drivers.

Figure 10:
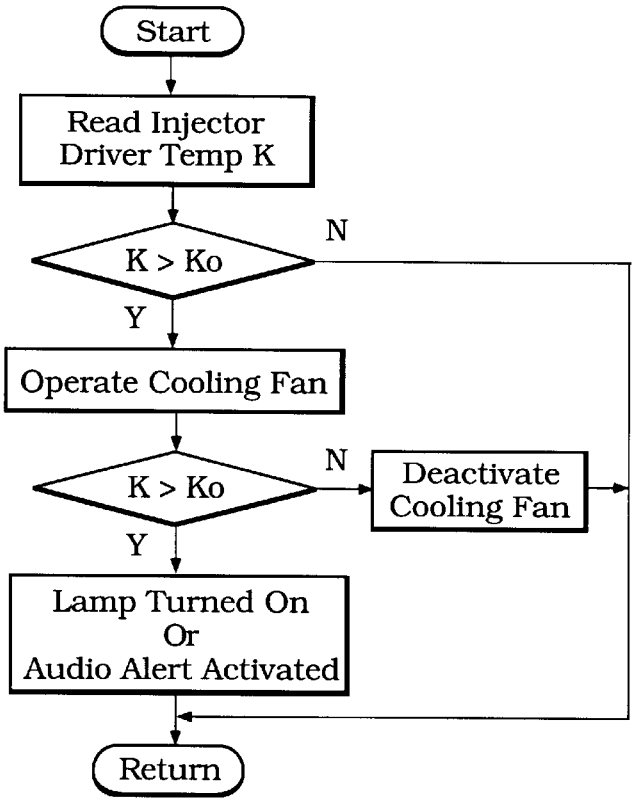
FIG. 10 is a flow chart depicting yet another embodiment of a fuel injection control system having features, aspects and advantages in accordance with the present invention; and, FIG. 11 is a top view of an outboard motor with a four-cycle engine having a fuel injection system arranged and configured according to various features, aspects and advantages of the present invention, with a main cowling portion of the motor shown with phantom lines and some other internal components shown with hidden lines.

With reference now to FIG. 10, a further embodiment of a control system is depicted in a flow diagram. As illustrated, the actual temperature K of the injector drivers is read through the use of the sensors 228. This temperature may be taken from the injector driver directly or through measuring the air temperature within the injector driver box 222. It is also envisioned that the actual temperature of the injector drivers may be monitored as well.

In a decision block, the actual temperature K is compared against a predetermined temperature $K_0$ as described above. If the actual temperature K has not exceeded the predetermined temperature $K_0$, then the routine begins again by sampling the actual temperature of the injector drivers. On the other hand, if the actual temperature exceeds the predetermined temperature, the cooling fan 230 is operated. The cooling fan increases the air flow within the cowling and thereby increases the heat transferred away from the cooling fins 226 and, ultimately, the injector drivers.

With continued reference to FIG. 10, the actual temperature is then sampled again and compared to the predetermined temperature again in a decision block. If the temperature has decreased below the predetermined temperature, then the routine may deactivate the cooling fans 230 and return to the beginning. On the other hand, if the actual temperature has not decreased below the predetermined temperature, a visual, auditory or tactile warning indicator is preferably activated. In some embodiments, the warning indicator may include a warning light or buzzer. The routine then begins again to check for a change in conditions. Notably, the cooling fan continues to operate while the warning indicator is activated until the high temperature condition is obviated. In some embodiments, the cooling fan is operated continuously after the predetermined temperature is exceeded. In another embodiment, the cooling fan is operated even after engine shutdown until the drivers have cooled to a temperature below the predetermined temperature. It should be recognized that other techniques, such as engine speed reduction may also be used with the fan.

With reference now to FIG. 11, an embodiment of the present injector control system is illustrated in a four-cycle engine environment. As illustrated, an engine 26 is contained within a cowling 28 substantially as described above. The illustrated engine 26 features an air intake system with an inlet pipe 69 that is in communication with an intake port 240. A fuel injector 82 is arranged within the intake pipe 69 to create an air fuel charge for introduction into the combustion chamber. Notably, the fuel injector 82 may also be arranged for direct injection into the combustion chamber.

An intake control valve 242 is positioned to open and close the intake port 240 in a known manner such that the timing and duration of the induction of the air-fuel charge may be controlled. The illustrated intake control valve 242 is mechanically actuated by an associated camshaft 244. As the camshaft 244 rotates, the intake control valve 242 opens and closes the port 240.

Notably, the camshaft 244 may also power the high-pressure fuel pump 110 through a known pump drive unit 112. The fuel is passed through the vapor separator 96 to the fuel pump 110 as indicated in the embodiment illustrated in FIG. 1. The balance of the induction, ignition and exhaust systems are substantially as described above.

The control systems described above may be practiced with the four-cycle engine of FIG. 11 to reduce the operating temperature of the injector drivers. Moreover, the control systems described above may be utilized to control a fan to cool the ECU 78. It should be also noted that the features of this invention described above can be embodied in engines that operate on a four-stroke principle. In addition, these features are applicable to not only outboard motors but also to other various engines such as for example, but without limitation, inboard engines, lawn mower engines and stationary engines.

Of course, the foregoing description is that of preferred embodiments of the invention, and various changes and modifications may be made without departing from the spirit and scope of the invention, as defined by the following claims.

What is claimed is:

1. An engine control method comprising determining when a fuel injector driver overheat condition is impending and then initiating at least one of the following responses: reducing the speed of the engine by altering a volume of fuel injected by a fuel injector; reducing the speed of the engine by altering a timing of an initiation of fuel injection by the fuel injector; reducing the speed of the engine by altering an ignition timing; or activating a cooling fan to increase a level of heat transfer from the fuel injector driver.

2. The engine control method of claim 1 further comprising activating an operator alert device in response to the determination that the fuel injector overheat condition is impending.

3. An outboard motor comprising a power head, an internal combustion engine mounted within the power head, the internal combustion engine having at least one fuel injector, a fuel injector driver actuating the fuel injector, a fuel injector driver box containing the fuel injector driver, a sensor capable of monitoring the temperature of the fuel injector driver, and a control device communicating with the sensor whereby the control device can initiate an engine speed reduction technique when the fuel injector driver temperature exceeds a predetermined temperature.

4. The outboard motor of claim 3, wherein the engine speed reduction technique comprises altering a volume of fuel injected by the fuel injector.

5. The outboard motor of claim 3, wherein the engine speed reduction technique comprises altering a timing of an initiation of fuel injection by the fuel injector.

6. The outboard motor of claim 3, wherein the engine speed reduction technique comprises altering a timing of an ignition system.

7. The outboard motor of claim 3, wherein the engine further comprises a cylinder and wherein the fuel injector is arranged to inject fuel directly into the cylinder.

8. The outboard motor of claim 3 further comprising a fan positioned within the power head proximate the fuel injector driver box, wherein the control device can activate the fan if the fuel injector driver temperature exceeds a predetermined temperature.

9. The outboard motor of claim 8, wherein the fuel injector driver box includes a fin array disposed within an air flow induced by the fan.

10. The outboard motor of claim 8, wherein the control device can activate a warning indicator if the fuel injector driver temperature exceeds a predetermined temperature.

11. The outboard motor of claim 10, wherein the warning indicator comprises a warning lamp.

12. The outboard motor of claim 10, wherein the warning indicator comprises an auditory alert device.

13. An engine comprising a cylinder block, at least one cylinder defined within the cylinder block, at least one piston arranged for reciprocation within the cylinder, the piston connected to an output shaft, a combustion chamber defined within the cylinder between a cylinder head assembly and an upper surface of the piston, an induction system communicating with the combustion chamber, the induction system comprising a throttle valve and a fuel injector, the fuel injector including an injector driver, an engine speed sensor positioned proximate the output shaft and capable of reading an engine speed, a throttle position sensor capable of determining a throttle position angle and a control unit in communication with the engine speed sensor and the throttle position sensor, wherein the control unit is adapted to initiate an injector driver cooling operation when the engine speed sensor indicates an engine speed above a predetermined engine speed and the throttle position sensor indicates a throttle position angle larger than a predetermined angle.

14. The engine of claim 13, wherein the engine operates on the four-cycle principle.

15. The engine of claim 13 further comprising a timing component adapted to time a period of time in which the engine speed sensor indicates an engine speed above a predetermined engine speed and the throttle position sensor indicates a throttle position angle larger than a predetermined angle.

16. The engine of claim 15, wherein the control unit initiates an injector cooling operation when the period of time exceeds a predetermined period of time.

17. The engine of claim 16, wherein the engine speed reduction technique comprises altering a volume of fuel injected by the fuel injector.

18. The engine of claim 16, wherein the engine speed reduction technique comprises altering a timing of an initiation of fuel injection by the fuel injector.

19. The engine of claim 16, wherein the engine speed reduction technique comprises altering a timing of an ignition system.

20. The engine of claim 13 further comprising a fan and an injector driver temperature sensor in communication with the control unit.

21. The engine of claim 20, wherein the fan is operated when the injector driver temperature exceeds a predetermined temperature.

* * * * *